US005579906A

United States Patent [19]

Fabbri et al.

[11] Patent Number: 5,579,906

[45] Date of Patent: Dec. 3, 1996

[54] ARTICLE DISPLAY CONTAINER

[75] Inventors: Terence Fabbri, Vista, Calif.; Jack H. Schechter, Birmingham, Mich.

[73] Assignee: Advance Watch Company, Ltd., Southfield, Mich.

[21] Appl. No.: 535,618

[22] Filed: Sep. 28, 1995

[51] Int. Cl.[6] ..... B65D 85/40

[52] U.S. Cl. ..... 206/301; 206/18; 206/1.5; 206/45.2; 206/756; 206/781

[58] Field of Search ..... 206/301, 18, 566, 206/6.1, 736, 756, 762, 764, 765, 769, 775, 776, 781, 782, 45.2, 45.24, 1.5; 70/57.1, 58

[56] References Cited

U.S. PATENT DOCUMENTS

| | | | |
|---|---|---|---|
| D. 322,189 | 12/1991 | Schechter . | |
| 1,681,092 | 8/1928 | Bulova | 206/566 X |
| 2,178,652 | 11/1939 | Shields | 206/301 X |
| 2,253,212 | 8/1941 | Rathbun | 206/566 X |
| 4,005,775 | 2/1977 | Crosslen | 206/301 X |
| 4,082,183 | 4/1978 | Storm | 206/301 |
| 4,216,858 | 8/1980 | Beauchamp | 206/6.1 X |
| 4,830,181 | 5/1989 | Hartman | 206/301 X |
| 5,188,222 | 2/1993 | Pierce | 206/301 X |
| 5,322,159 | 6/1994 | Houlihan | 206/45.2 |
| 5,377,822 | 1/1995 | Herzog | 206/301 X |
| 5,383,552 | 1/1995 | Dikowitz | 206/6.1 |

*Primary Examiner*—Paul T. Sewell
*Assistant Examiner*—Tara L. Laster
*Attorney, Agent, or Firm*—Brooks & Kushman

[57] ABSTRACT

A security display container for alternately displaying and transporting a watch or the like that includes a housing having a tongue which forms a first part of a snap-lock, the tongue itself having a first latch portion. The display container also includes a retainer member for securing and displaying the watch which is removably receivable in the housing and which forms a second part of a snap-lock that is received under the tongue in order to snap lock the retainer member to the housing. The retainer member further having a second latch portion that is aligned with the first latch portion and a fastener which is receivable through the first and second latch portions to connect the retainer member to the housing. The security display container is adapted to receive a cover which is mateable with the housing in a nesting orientation for displaying the watch and in an enclosing orientation for transporting the watch.

20 Claims, 3 Drawing Sheets

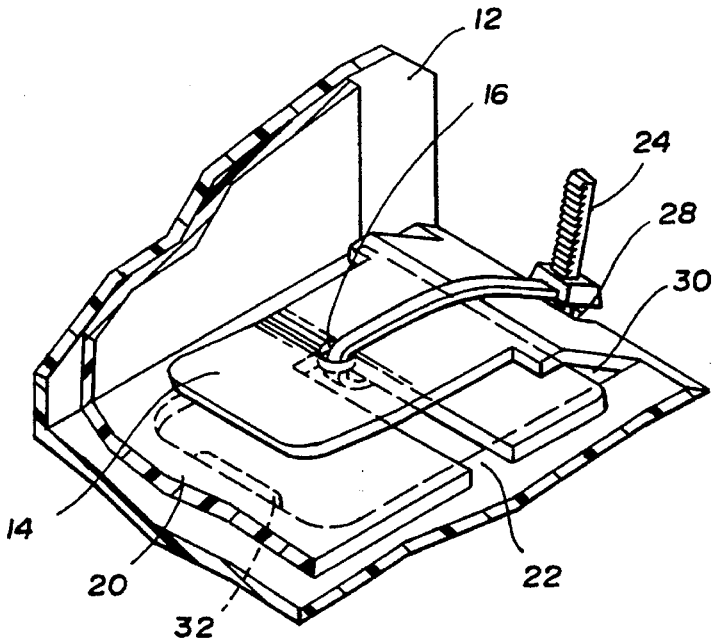
Fig. 4
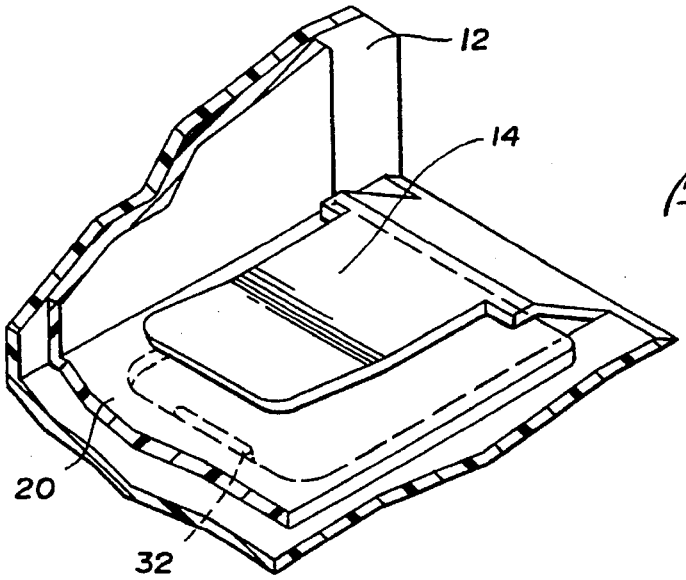
Fig. 5
(PRIOR ART)
Fig. 6
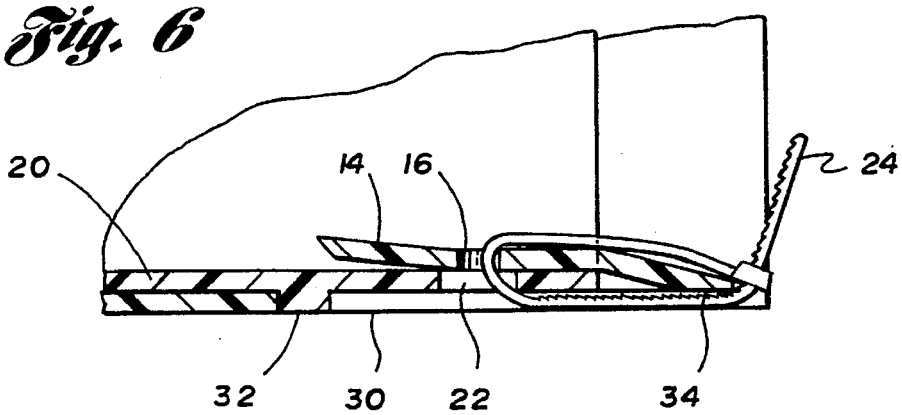

ARTICLE DISPLAY CONTAINER

TECHNICAL FIELD

This invention relates to a security display container for alternately displaying and transporting an article such as a watch.

BACKGROUND ART

Merchants are continually looking for ways to better secure their inventory from the likes of thieves and shoplifters, or at least to make the thief's task more difficult. This is especially true when the goods at issue are watches or other small articles which can be easily removed from an open display and placed in one's purse or pocket without attracting attention. While security measures such as keeping goods behind lock-and-key in a glass case may be effective, they do not allow the serious shopper or browser to touch, feel, try on, or closely inspect the merchandise.

Conventional display boxes for articles such as watches and the like are of relatively simple construction. They commonly consist of a one or two-piece housing having an opening wherein either the watch itself or a removable watch-holding member sits. While this type of construction permits the display of the watch or other article, it does not secure the watch or watch-holding member to the housing or otherwise protect the article or watch from being unexpectedly removed from the housing. Therefore, with the conventional design, the watch can be easily removed from the display by a shoplifter without ever creating any suspicion on the part of the unsuspecting merchant. The conventional design also does not provide for the watch to be securely contained during the commonly turbulent shipping and handling operations.

Consequently, a need has developed for an improved display container for watches or the like which will securely retain the watch while allowing a shopper to touch, feel and inspect the merchandise up close. In addition, the improved display container should affirmatively hold the article so that it cannot be easily removed from a merchant's display. An improved display container will further securely hold a watch or other article during shipping and handling operations.

SUMMARY OF THE INVENTION

It is a principle object of the present invention to provide an improved display container for securely retaining an article within its housing.

It is a further object of the present invention to provide an improved display container with a two-part housing, each part mating with each other in two alternate orientations, one for transporting an article and one for displaying the article.

In carrying out the above objects, features and advantages of the present invention, the display container includes a housing having a tongue which forms a first part of a snap-lock. The tongue includes a first latch portion. The invention also includes a retainer member for securing and displaying the article which is removably receivable in the housing and has a base. This base forms a second part of the snap-lock which is receivable under the tongue to snap lock the retainer member to the housing. The retainer member further includes a second latch portion which is aligned with the first latch portion. This second latch portion is preferably located on the base of the retainer member.

The display container also includes a fastener which is received through the first and second latch portions and is able to removably connect the retainer member to the housing. In a preferred embodiment, the display container has a cover mateable with the housing. The housing and cover are mateable in two orientations, the first being a nesting orientation for displaying the article and the second being in an enclosing orientation for transporting the article. Preferably, the housing and cover are also triangularly shaped. Further, the first latch portion is a first aperture through the tongue, the second latch portion is a second aperture through the base and the fastener is a standard tie strap.

In this preferred embodiment, the housing also includes a recess to accommodate the bulk or head of the fastener. The housing further includes an opening under the tongue and the base includes a transverse rib which is receivable in the opening and biased there into by the tongue.

The above objects and other objects, features and advantages of the present invention are readily apparent from the following detailed description of the best modes for carrying out the invention when taken in connection with the accompanying drawings wherein like reference numerals correspond to like components.

BRIEF DESCRIPTION OF THE DRAWINGS

FIG. 4 is a fragmentary front perspective view illustrating the features as set forth in the preferred embodiment of the article display container of the present invention;

FIG. 5 is a fragmentary front perspective view of a prior art display box; and FIG. 6 is a side elevational view of the assembly of FIG. 4 of the article display container of the present invention.

BEST MODES FOR CARRYING OUT THE INVENTION

Figure 1:
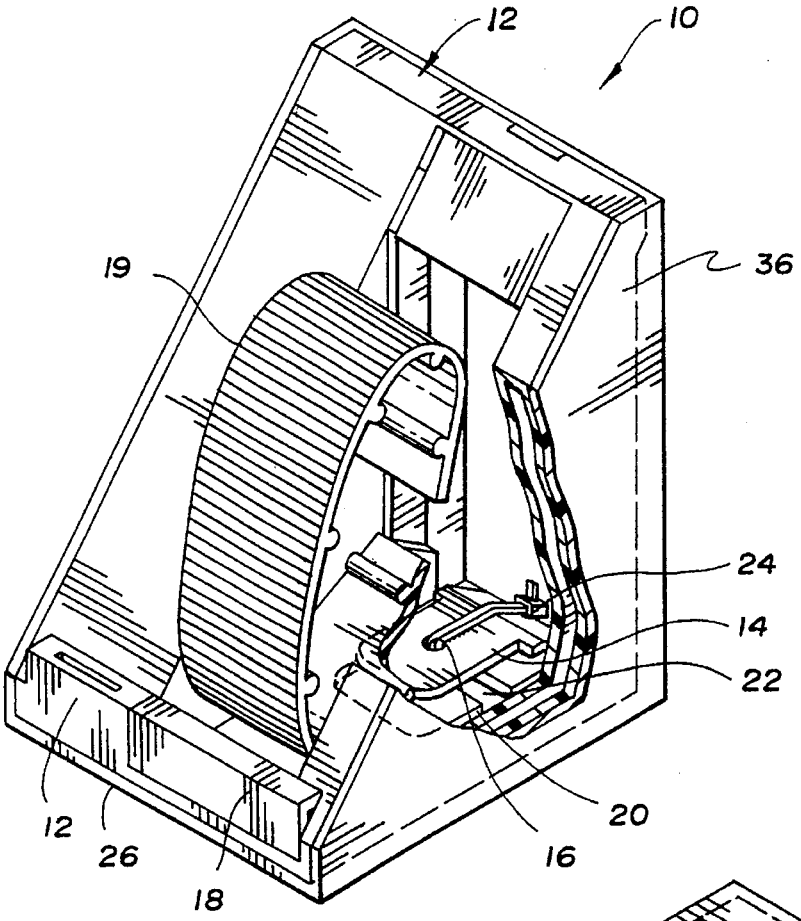
FIG. 1 is a perspective view of the article display container of the present invention in its displaying orientation.

The article display container of the present invention is shown in FIGS. 1–4 and 6 of the drawings. As seen, the container 10 includes a housing 12 having a bottom portion 13 having a raised tongue 14 which forms a first part of a snap-lock. The housing 12 includes a first latch portion 16, which is preferably located in the tongue 14 of the housing 12. The invention also includes a retainer member 18 having means for securing and displaying the watch 19. This retainer member 18 is removably receivable in the housing 12.

The retainer member 18 has a base 20 which forms a second part of the snap lock and is received under the raised tongue 14 in order to snap lock the retainer member 18 to the housing 12 as shown in FIG. 1. The retainer member 18 further has a second latch portion 22, provided in the base 20 of the retainer member 18 as shown in FIGS. 1 and 4. This second latch portion 22 is aligned with the first latch portion 16. A fastener 24 is received through the first latch portion 16 and the second latch portion 22 to removably connect or latch the retainer member 18 in the housing 12 as shown in FIG. 6. The fastener 24 can be removed by such operations as severing, penetrating or untwisting the fastener 24.

Figure 2:
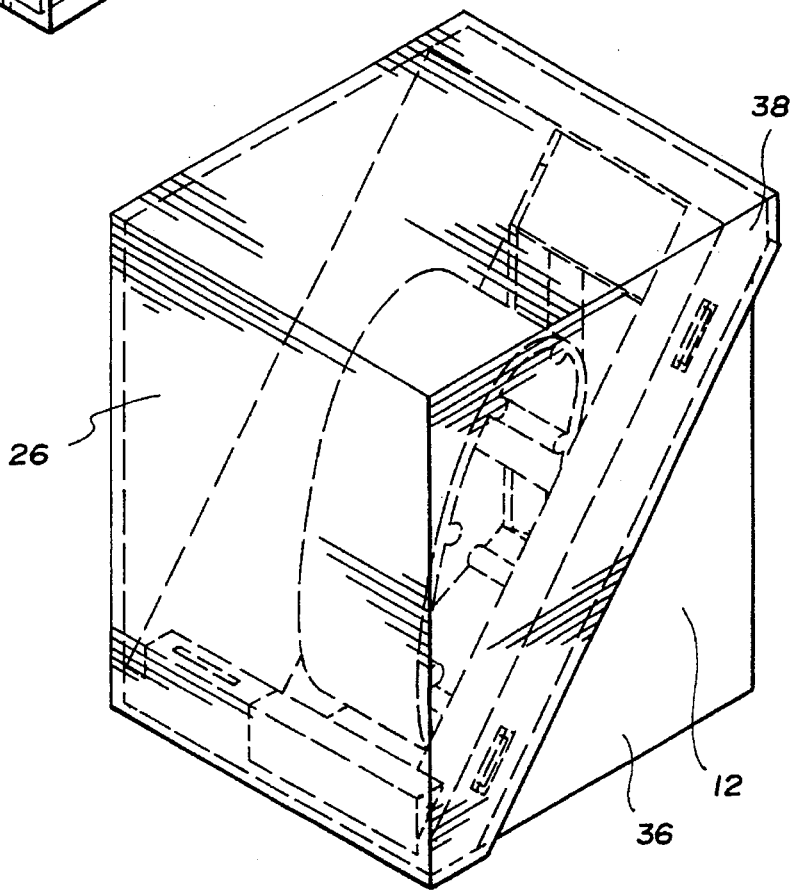
FIG. 2 is a perspective view of the article display container of the present invention in its transporting orientation.
Figure 3:
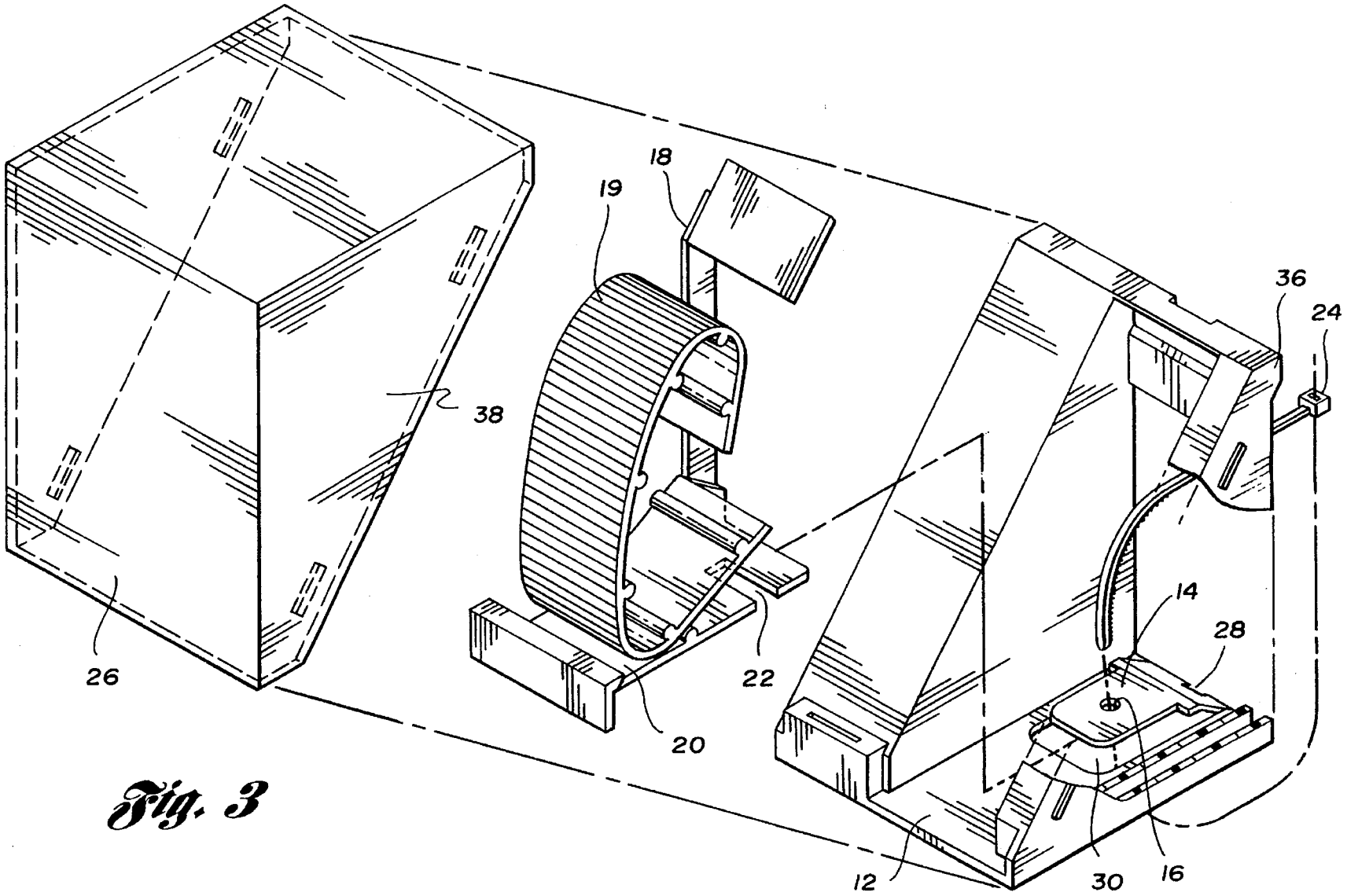
FIG. 3 is a schematic diagram of the article display container of the present invention illustrating how the components are assembled.

The display container described herein is specifically directed for use with a cover 26, such as that shown in FIGS. 2 and 3 of the drawings. The cover 26 is mateable with the housing 12 in two different orientations. The first orientation is a nesting orientation which permits the watch to be displayed as shown in FIG. 1. The second orientation is an enclosing orientation which permits the article to be safely transported as illustrated in FIG. 2 of the drawings. Although housing 12 and cover 26 may be of any three-dimensional shape, it is preferable that they each have triangular shaped side walls 36 and 38, respectively, as illustrated in FIGS. 1, 2 and 3.

In a preferred embodiment, the first latch portion 16 is formed by an aperture through the tongue 14 of the housing 12. The second latch portion 22 is formed by an aperture in retainer member 18, located preferably in the base 20 of the retainer member 18. The fastener 24 is preferably a tie strap, having teeth at one end and an eyelet at the other end. When the toothed end is pulled through the eyelet to the desired position, it locks forming a loop in the tie strap as shown in FIG. 6. Such loop may be permanent, in which case scissors or another penetrating or severing object must be used to sever the loop and remove the fastener 24. Later, if it is necessary to reattach the components, a new tie strap may be inserted through the latch portions. If a temporary lock is formed by utilizing a re-usable tie strap in the assembly, the tie strap can be removed and re-used over and over again. However, the fastener 24 may, of course, be of any suitable type so long as it functions to secure the retainer member 18 to the housing 12.

Referring to FIG. 3, it can be seen that housing 12 is adapted to receive a corresponding retainer member 18. The housing 12 includes a raised tongue 14, while the retainer member 18 has a base 20 which is received under the tongue 14 in order to snap lock the retainer member 18 into the housing 12. More specifically, the housing further includes an opening 30 under the tongue 14 which receives a transverse rib 32 of the base 20 when the base is fully inserted into the housing 12 to lock the retainer member 18 in the housing 12. The rib 32 is biased into the opening 30 by the tongue 14. The housing 12 also preferably will include a recess 28 at the base 34 of the tongue 14 to accommodate or provide a lower profile for the fastener 24.

The latch portion 16 of the housing 12 is a first aperture, shown in FIG. 1, 3 and 4 as preferably a hole located in the tongue 14. The retainer member 18 has a second aperture as the second latch portion 22, which is preferably a slot 22 and is preferably located in the base 20 of the retainer member 18, as shown in FIGS. 3 and 4. As further illustrated in FIGS. 4 and 6, the hole 16, being the first aperture, and the slot 22, being the second aperture, are aligned with each other to receive a fastener 24, such as the tie strap 24 shown in the drawings. The fastener 24 preferably removably attaches the base 20 to the tongue 14, thereby securing the housing 12 to the retainer member 18. Comparing a prior art display box shown in FIG. 5 with the embodiment of the present invention illustrated in FIG. 4, the prior art display box lacks the latch portions, 16 and 22, the fastener 24 and the recess 28 of the present invention. These features provide the security to the present invention by retaining the retainer member 18 to the housing 12.

When the fastener 24 is inserted through the latch portions and assembled as in FIG. 4, the housing may include an additional cut-out or recess 28 in order to accommodate the size of the fastener 24 or to provide a lower profile for the fastener 24 to prevent it from interfering with other components in the assembly. This recess 28 is preferably provided adjacent to the base of the tongue 14. After these components are assembled, the cover 26 may then be placed into either of its two orientations to mate with the housing 12.

The first orientation is a nesting orientation as shown in FIG. 1. Through this nesting position, the housing 12 is received within the cover 26, allowing the watch or other article which is secured on the retainer member 18 to be visible and accessible. In the nesting orientation, the fastener 24 is preferable either not accessible or not easily accessible to prevent undesired access to the fastener 24. The second orientation, illustrated in FIG. 2, is an enclosing orientation, whereby the cover 26 is placed into position over the front of the housing 12, thereby covering the retainer member 18 and any accompanying article so that the article, such as a watch, is protected during transport. The fastener 24 would also not preferably be accessible during this orientation.

Preferably, the components of the present invention are all comprised of a structural plastic. Various cross-sectional views are provided in FIGS. 4 and 6 of the drawings, to more fully illustrate the features of the present invention. Features clearly illustrated in FIG. 6 include the locking loop made by the preferred fastener 24, being the tie strap, or the way in which transverse rib 32 is biased into the opening 30 by the raised tongue 14.

While the best mode for carrying out the invention has been described in detail, those familiar with the art to which this invention relates will recognize various alternative designs and embodiments for practicing the invention as defined by the following claims.

What is claimed is:

1. A security container for alternately transporting and displaying an article, comprising:

a housing having a tongue which forms a first part of a snap-lock, said tongue having a first latch portion;

a retainer member having means for securing and displaying the article, said retainer member being removably receivable in said housing, said retainer member having a base forming a second part of said snap-lock receivable under said tongue to snap lock said retainer member to said housing, said retainer member further having a second latch portion aligned with said first latch portion; and a fastener receivable through said first and second latch portions to removably connect said retainer member to said housing.

2. The security container of claim 1 further comprising a cover mateable with said housing in a nesting orientation for displaying the article and in an enclosing orientation for transporting the article.

3. The security container of claim 2 wherein said housing and said cover each have triangular shaped side walls.

4. The security container of claim 1 wherein said first latch portion is a first aperture through said tongue and said second latch portion is a second aperture through said base.

5. The security container of claim 1 wherein said retainer member is removable from said housing by severing said fastener.

6. The security container of claim 1 wherein said fastener is a tie strap.

7. The security container of claim 1 wherein the article is a watch.

8. The security container of claim 1 wherein said housing includes a recess to accommodate said fastener.

9. The security container of claim 1 wherein said housing includes an opening under said tongue and said base includes a transverse rib receivable in said opening of the housing, the transverse rib biased into said opening by said tongue.

10. A security container for alternately displaying and transporting an article, comprising:

a housing having a tongue which forms a first part of a snap-lock, said tongue having a first latch portion;

a cover mateable with said housing in a nesting orientation for displaying the article and in an enclosing orientation for transporting the article;

a retainer member having means for securing and displaying the article, said retainer member being removably receivable in said housing, said retainer member having a base forming a second part of said snap-lock receivable under said tongue to snap lock said retainer member in said housing, said base having a second latch portion aligned with said first latch portion; and a fastener receivable through said first and second latch portions to removably connect said tongue to said base.

11. The security container of claim 10 wherein said housing and said cover each have triangular shaped side walls.

12. The security container of claim 10 wherein said first latch portion is a first aperture and said second latch portion is an aligned second aperture.

13. The security container of claim 10 wherein said tongue is removable from said base by severing said fastener.

14. The security container of claim 10 wherein said fastener is a tie strap.

15. The security container of claim 10 wherein the article is a watch.

16. The security container of claim 10 wherein the housing includes a recess provided adjacent to said tongue to accommodate the fastener.

17. The security container of claim 10 wherein said housing includes an opening under said tongue and said base includes a transverse rib receivable in said opening of said housing, said transverse rib biased into said opening by said tongue.

18. A security container for alternately displaying and transporting a watch, comprising:

a housing having a pair of triangular shaped side walls, said housing having a tongue which forms a first part of a snap-lock, said tongue having a first aperture;

a cover having a mating pair of triangular shaped side walls, said cover mateable with said housing in a nesting orientation for displaying the watch and in an enclosing orientation for transporting the watch;

a retainer member having means for securing and displaying the watch, said retainer member being removably receivable in said housing, said retainer member having a base forming a second part of said snap-lock, said base receivable under said tongue to snap lock said retainer member in said housing, said retainer member further having a second aperture aligned with said first aperture; and a tie strap receivable through said first and second apertures to connect said base of said retainer member to said tongue of said housing.

19. The security container of claim 18 wherein said housing includes a recess adjacent to said tongue to accommodate said tie strap.

20. The security container of claim 18 wherein said housing includes an opening under said tongue and said base includes a transverse rib receivable in said opening of said housing, said transverse rib biased into said opening by said tongue.

* * * * *